US010077897B2

(12) United States Patent
Hall et al.

(10) Patent No.: US 10,077,897 B2
(45) Date of Patent: Sep. 18, 2018

(54) TOILET WITH AN LED DIFFUSER STRIP

(71) Applicants: David R. Hall, Provo, UT (US); Dan Allen, Springville, UT (US); Joshua Larsen, Spanish Fork, UT (US); Jared Reynolds, Pleasant Grove, UT (US)

(72) Inventors: David R. Hall, Provo, UT (US); Dan Allen, Springville, UT (US); Joshua Larsen, Spanish Fork, UT (US); Jared Reynolds, Pleasant Grove, UT (US)

( * ) Notice: Subject to any disclaimer, the term of this patent is extended or adjusted under 35 U.S.C. 154(b) by 2 days.

(21) Appl. No.: 15/176,728

(22) Filed: Jun. 8, 2016

(65) Prior Publication Data

US 2017/0254526 A1 Sep. 7, 2017

Related U.S. Application Data

(60) Provisional application No. 62/303,233, filed on Mar. 3, 2016.

(51) Int. Cl.

| | |
|---|---|
| ***F21V 33/00*** | (2006.01) |
| ***F21V 3/00*** | (2015.01) |
| ***F21S 4/24*** | (2016.01) |
| ***A47K 17/02*** | (2006.01) |
| *F21Y 115/10* | (2016.01) |
| *F21Y 103/37* | (2016.01) |
| *F21V 7/00* | (2006.01) |
| *F21V 13/04* | (2006.01) |

(52) U.S. Cl.

CPC ..... *F21V 33/004* (2013.01); *A47K 17/02* (2013.01); *F21S 4/24* (2016.01); *F21V 3/00* (2013.01); *F21V 7/005* (2013.01); *F21V 7/0008* (2013.01); *F21V 13/04* (2013.01); *F21Y 2103/37* (2016.08); *F21Y 2115/10* (2016.08)

(58) Field of Classification Search

CPC . F21V 33/004; F21V 3/00; F21S 4/24; A47K 17/02

USPC ..... 362/253

See application file for complete search history.

(56) References Cited

U.S. PATENT DOCUMENTS

| | | | | | |
|---|---|---|---|---|---|
| 5,136,476 | A * | 8/1992 | Horn | A47K 17/00 | 362/198 |
| 5,276,595 | A * | 1/1994 | Patrie | A47K 13/30 | 362/101 |
| 5,664,867 | A * | 9/1997 | Martin | A47K 13/00 | 340/686.1 |
| 6,074,074 | A * | 6/2000 | Marcus | B29C 45/14655 | 362/234 |
| 6,404,131 | B1 * | 6/2002 | Kawano | G09F 9/33 | 257/E33.072 |
| 6,964,497 | B2 * | 11/2005 | Greiner | G02B 6/0021 | 362/23.12 |
| 9,581,312 | B2 * | 2/2017 | Rodgers | F21V 5/008 | |
| 2003/0002294 | A1 * | 1/2003 | Chiang | B60Q 1/2696 | 362/545 |
| 2010/0290215 | A1 * | 11/2010 | Metcalf | A47B 21/00 | 362/127 |

(Continued)

*Primary Examiner* — Bryon T Gyllstrom

(57) ABSTRACT

A two-piece toilet with a seam and a channel at an intersection of the two toilet pieces is disclosed. An LED strip and diffuser strip are used to fill in the channel and hide seam of the intersection of the two toilet pieces. The LED strip transmits light into the channel and the light is refracted off of the channel and through the diffuser strip on the back side of the LED strip. An exterior and interior of a toilet may be lighted by the LED strip.

18 Claims, 10 Drawing Sheets

(56) References Cited

U.S. PATENT DOCUMENTS

| | | | | |
|---|---|---|---|---|
| 2012/0023651 | A1* | 2/2012 | Taylor | A47K 13/24 4/234 |
| 2012/0068613 | A1* | 3/2012 | Veneto | A47K 13/24 315/159 |
| 2013/0314913 | A1* | 11/2013 | Lee | F21V 7/22 362/235 |
| 2014/0070724 | A1* | 3/2014 | Gould | F21V 13/02 315/291 |

* cited by examiner

TOILET WITH AN LED DIFFUSER STRIP

RELATED APPLICATIONS

This application claims priority to U.S. Provisional Application No. 62/303,233, filed Mar. 3, 2016, entitled Indirect Viewing LED Diffuser Strip.

BACKGROUND

Field of the Invention

This invention relates to methods for incorporating lighting elements into a multi-part toilet.

Background of the Invention

Using a toilet is a necessary daily experience for most people, but traditional porcelain toilets can be heavy and it is difficult to accommodate auxiliary features within typical porcelain molds. Though the porcelain toilet is a standard feature in most homes and public spaces, some do not like its appearance.

SUMMARY

To address the issue of how to provide lighting features on the toilet and/or in the toilet, the innovation utilizes a unique two-piece toilet design that accommodates a diffuser strip positioned in a seam channel at an intersection of the two pieces of the toilet. A first diffuser strip may be located adjacent to an LED (light emitting diode) strip. A second diffuser strip may be located on an opposite side of the LED strip compared to the first diffuser strip.

The two-piece toilet design includes a top section of the toilet apparatus that may be removed and attached to a bottom section of the toilet apparatus. A seam forms a channel at an intersection of the top and bottom sections of the toilet. This is where the strip of LEDs and the diffuser strip are located, and various configurations of the elements may be used.

The diffuser may be made out of metal, glass, plastic, or some other diffusive material. The diffuser is used to give light an even, soft appearance and feel.

Light from the LED strip may be transmitted toward the channel, into the toilet apparatus through a partially transparent toilet section, or around the external perimeter of the toilet apparatus by reflecting off of the channel formed by the seam of a top toilet section and a bottom toilet section. Some combination of the above may be incorporated into the design. A variety of effects may be used to increase the visual appeal of the light such as changing light color, light intensity, light brightness patterns within the strip of LEDs, light color patterns within the strip of LEDs.

The LED strip may display light of different colors. Furthermore, the color of light emanating from the LED strip may change depending on the status of the toilet. In one example, a toilet equipped with voice recognition or bio-recognition software may flash green when confronted with a familiar user or red when confronted with an unfamiliar user.

Patterns of light intensity and color may be used to change a mood of a restroom or may provide information to a toilet user such as a length of time using a toilet.

The toilet may be equipped with a device that senses movement, and the LED strip may respond to this movement in a variety of ways. In one example, a user approaching the toilet in the dark may trigger a sensor that activates the LED strip, thereby providing light to help the user safely navigate his or her way to the toilet or around a restroom.

The diffuser may utilize a solid stream of lights, a series of flashing lights, or a combination of both. The strip of lights may perform a variety of visual functions depending on the status of the toilet. In one example, the strip of lights may flash when the user flushes the toilet.

The toilet may be equipped with a wireless audio system that can play music or deliver sound coming from a cell phone or other Bluetooth enabled device. In such a scenario, the LED strip may be synchronized with the audio system to provide a dual visual and aural element to the toilet apparatus. In one example, lights in the LED strip may flash concurrently with the beat of the music emanating from the audio system.

A device may be incorporated into the toilet that allows the user to change the settings for the LED light diffuser. This would permit the user to adjust at will the brightness, intensity, animation, and color of the light in the diffuser.

The toilet apparatus may be constructed of at least one or more transparent or semi-transparent materials, allowing light to diffuse through the exterior of the toilet. In one example, ultraviolet light may be diffused to neutralize harmful bacteria in the toilet bowl.

A two-piece toilet with a seam and a channel at an intersection of the two toilet pieces is disclosed. An LED strip and diffuser strip are used to fill in the channel and hide seam of the intersection of the two toilet pieces. The LED strip transmits light into the channel and the light is refracted off of the channel and through the diffuser strip on the back side of the LED strip. An exterior and interior of a toilet may be lighted by the LED strip.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings, in which.

DETAILED DESCRIPTION

It will be readily understood that the LED substrates of the present invention, as generally described and illustrated in the Figures herein, may be arranged and designed in a wide variety of different configurations. Thus, the following more detailed description of the embodiments of the invention, as represented in the Figures, is not intended to limit the scope of the invention, as claimed, but is merely representative of certain examples of presently contemplated embodiments in accordance with the invention. The presently described embodiments will be best understood by reference to the drawings.

Figure 1:
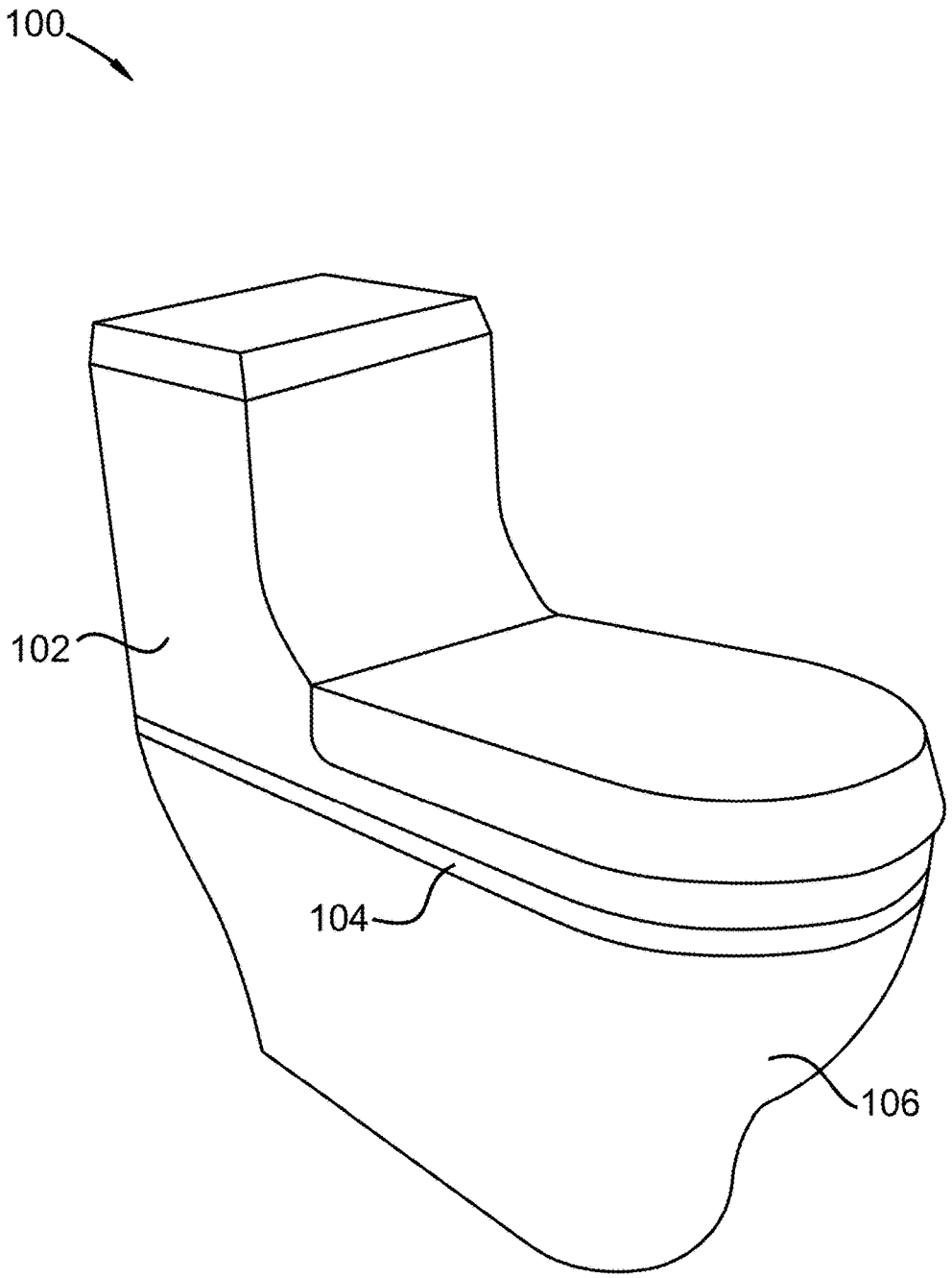
FIG. 1 is an isometric view of an embodiment of a two-piece toilet apparatus with a diffuser strip and LED strip in accordance with an embodiment of the invention.

Referring to FIG. 1, a toilet apparatus 100 in accordance with the invention is illustrated. The toilet 100 has two sections, a top section 102 and bottom section 106. The two sections are joined to create a seam 104 forming a channel. The seam and channel are covered with a diffuser strip and LED strip as shown in later drawings. The toilet apparatus may be constructed of a variety of non-porcelain, non-ceramic materials such as fiberglass reinforced plastic, aka "engineered stone", a molded plastic, a thermoplastic, or some other material which has properties advantageous for precise manufacturing and connecting various LED substrates. The toilet apparatus may be made of a transparent or semitransparent material.

Figure 2:
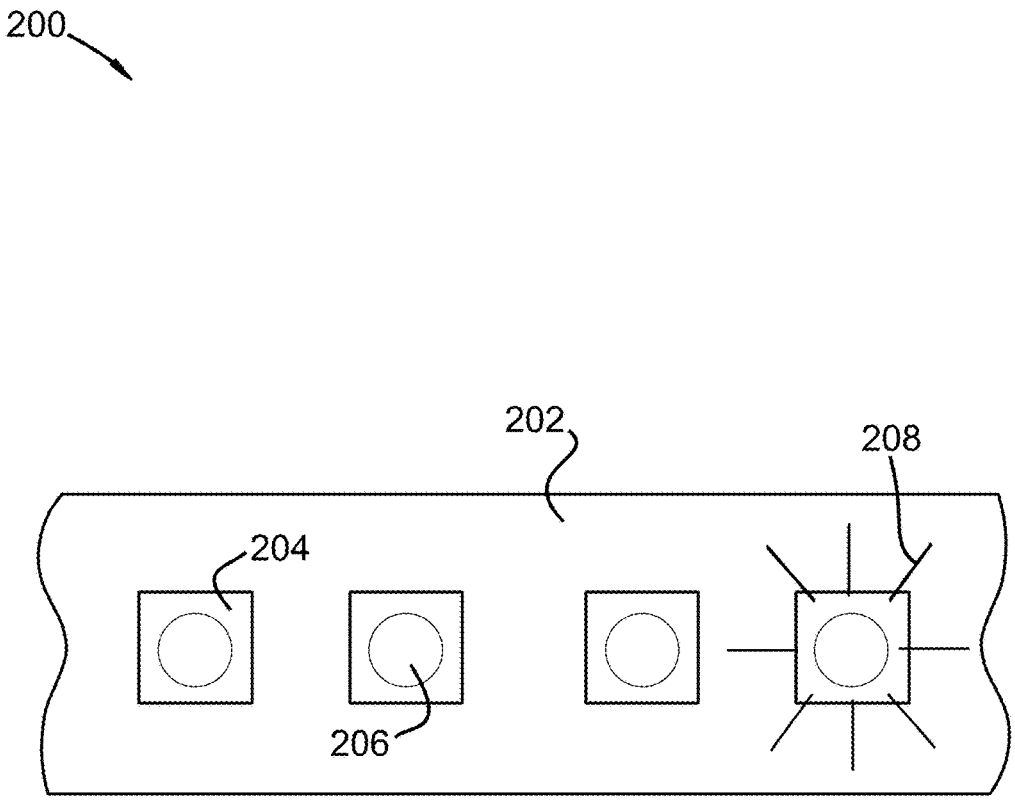
FIG. 2 is a detailed view of an LED strip in accordance with an embodiment of the invention.

FIG. 2 shows a strip of LED lights 200. The strip itself 202 may be made of rubber, plastic, adhesive tape, glue, flexible PCB material, or other materials which are capable of supporting embedded wiring and LEDs. The strip may be located adjacent to a diffuser, as shown in later drawings. Within the strip is a series of LED lights 206 and a LED substrate 204 joining the LEDs to the strip. The LED substrate joining the LEDs to the strip may be of an identical material to the strip or may be constructed of some other material conducive to joining LEDs to the strip. The LEDs may be uniform in color or varied in color. The LEDs may change color based on the status of the toilet apparatus. The LED strip may also be equipped with a function to enable a user to change the color of the LEDs. The LEDs may have a default, non-variable brightness setting or the brightness may change depending on the status of the toilet apparatus. The LED strip may be equipped with a function to enable a user to change the brightness of the LEDs. The LEDs may be static with two settings (e.g. "on" and "off") or they may flash at variable speeds and in various configurations depending on the status of the toilet apparatus. The LED strip may be equipped with a function to enable a user to adjust the animation of the LEDs. A flashing light bulb is shown in 208. The toilet apparatus may be equipped with voice recognition or bio-recognition software. In this case, the LED strip may be programmed to respond with a given color, brightness, intensity, or animation depending on whether the toilet apparatus is confronted with a familiar or unfamiliar user.

Figures 3A, 3B, 3C, 3D, 3E, 3F:
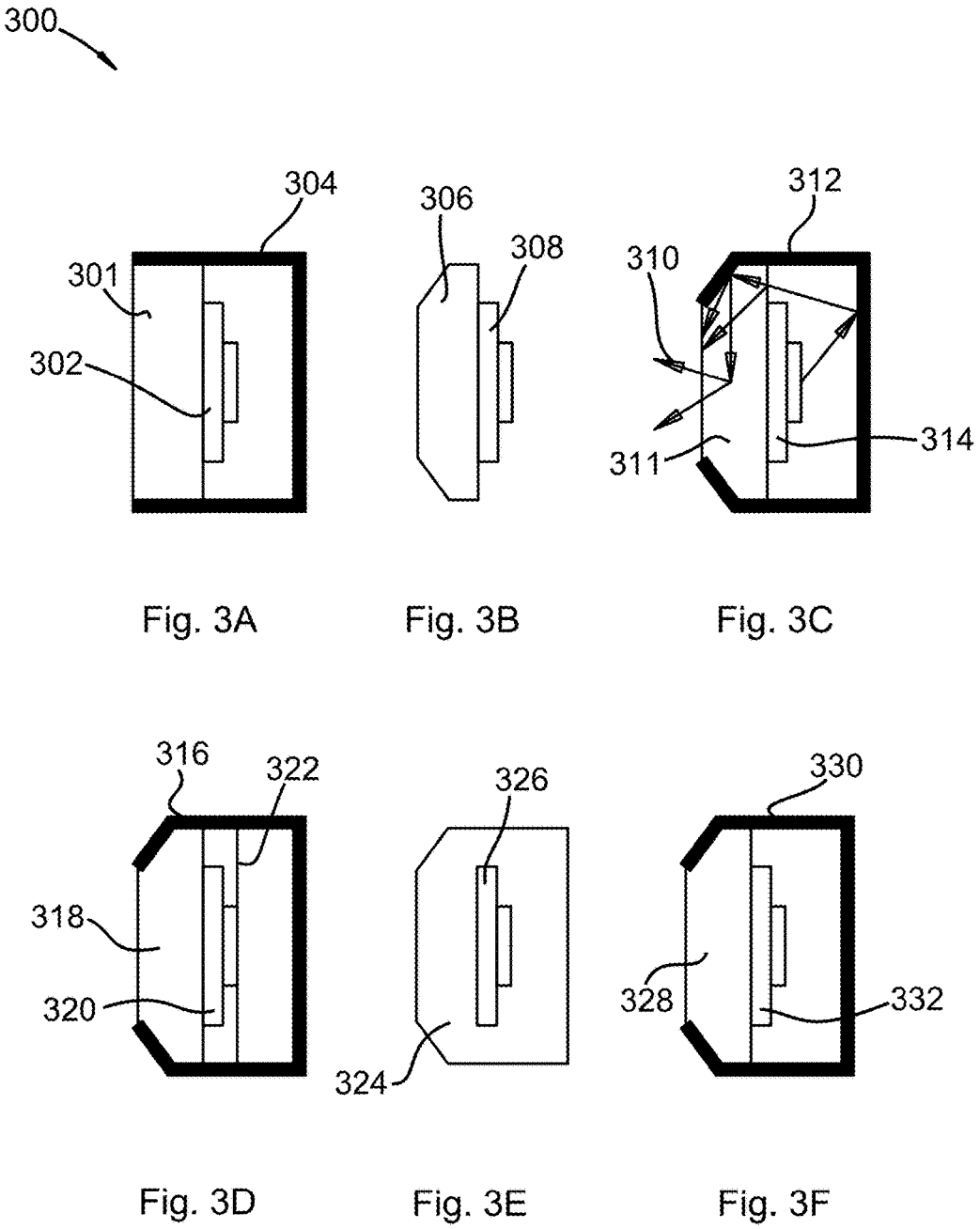
FIG. 3A shows a side view of the diffuser strip and LED strip in accordance with an embodiment of the invention.
FIG. 3B shows a side view of the diffuser strip and LED strip in accordance with an embodiment of the invention.
FIG. 3C shows a side view of the diffuser strip and LED strip in accordance with an embodiment of the invention.
FIG. 3D shows a side view of the diffuser strip and LED strip in accordance with an embodiment of the invention.
FIG. 3E shows a side view of the diffuser strip and LED strip in accordance with an embodiment of the invention.
FIG. 3F shows a side view of the diffuser strip and LED strip in accordance with an embodiment of the invention.

FIGS. 3*a-f* show various configurations 300 of the LED strip and diffuser strip in accordance with an embodiment of the invention. In FIG. 3*a*, the LED strip 302 and LED are joined within a channel formed by a seam 304 such as a fiberglass reinforced plastic, molded plastic, or thermoplastic. The diffuser 301 is located on a back side of the LED strip 302. LED strip 302 transmits light into the channel 304 away from diffuser 301 (as shown in 3*c*). In FIG. 3*b*, the diffuser strip 306 and LED strip 308 are shown without a toilet channel. In FIG. 3*c*, the diffuser strip 311 and LED strip 314 are joined within a toilet seam channel 312. Light emanating from the LED strip is refracted around channel 312 to an exterior side of the toilet 310. In FIG. 3*d*, the diffuser strips 318 and 322 and LED strip 320 are joined within a refractive channel material 316 such as a fiberglass reinforced plastic, molded plastic, or thermoplastic. In FIG. 3*e*, the diffuser strip 324 and LED strip 326 are shown outside of a channel formed by a toilet seam. In FIG. 3*f*, the diffuser strip 328 and LED strip 332 are inside of channel 330. The channel may be made of transparent or semi-transparent material allowing some of the light to be transmitted through the material and into the toilet bowl area of a toilet.

Figure 4:
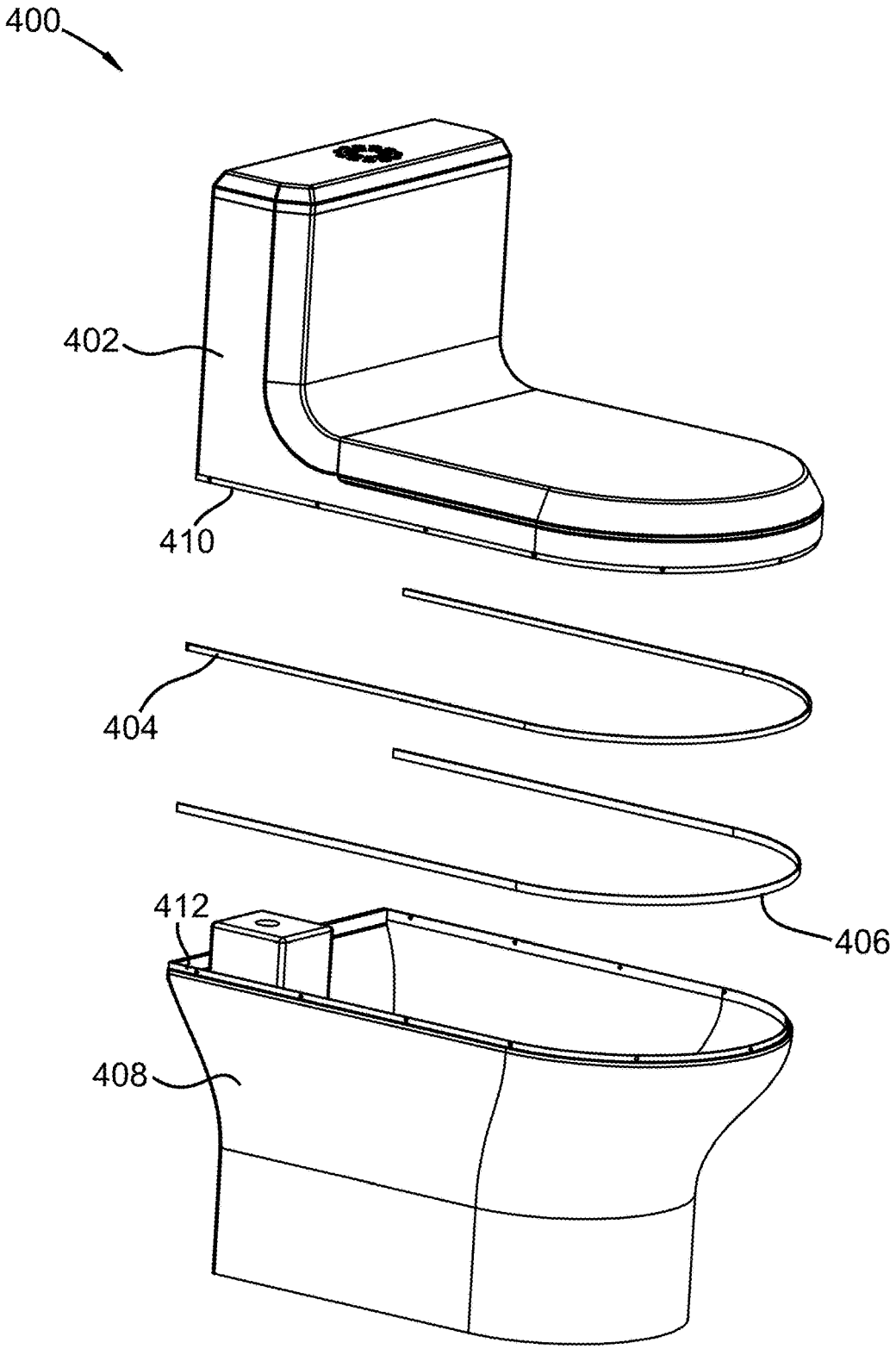
FIG. 4 is an exploded view of detached pieces of a two-piece toilet apparatus with a separated diffuser strip and LED strip in accordance with an embodiment of the invention.
Figure 5:
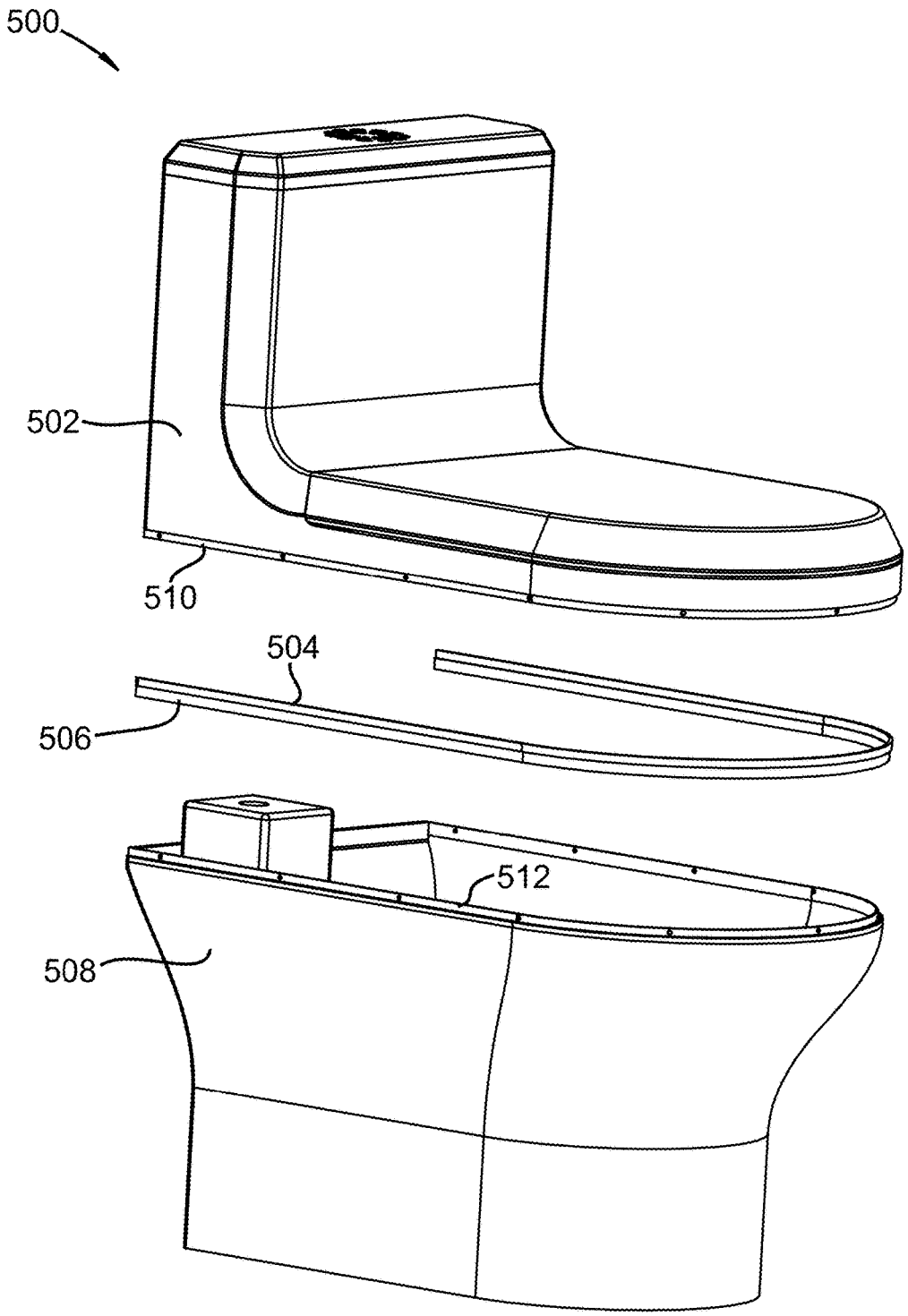
FIG. 5 is an exploded view of detached pieces of a two-piece toilet apparatus with a joined diffuser strip and LED strip in accordance with an embodiment of the invention.

FIGS. 4 and 5 show two possible configurations of the toilet apparatus in accordance with the invention. In FIG. 4, an embodiment of the two-piece toilet apparatus 400 with a top section 402 and bottom section 408. The two sections are joined together at channel sections 410 and 412 forming a seam and a channel. The two toilet sections may be joined together by glues, adhesive tapes, plastics, metals, screws or some other material conducive to joining plastics and other non-ceramic, non-porcelain LED substrates. In this illustration, the LED strip 404 and diffuser strip 406 are placed within the seam. An alternate configuration may have the diffuser strip located above the LED strip within the seam. In FIG. 5, an embodiment of the two-piece toilet apparatus 500 with a top section 502 and bottom section 508. The two sections are joined together at channel sections 510 and 512 forming a seam. As in FIG. 4, the two toilet sections may be joined together by glues, adhesive tapes, plastics, metals, screws or some other material conducive to joining plastics and other non-ceramic, non-porcelain LED substrates. In this illustration, the LED strip 504 and diffuser strip 506 are joined together within the seam. An alternate configuration may have the diffuser strip located above the LED strip within the seam.

Figure 6:
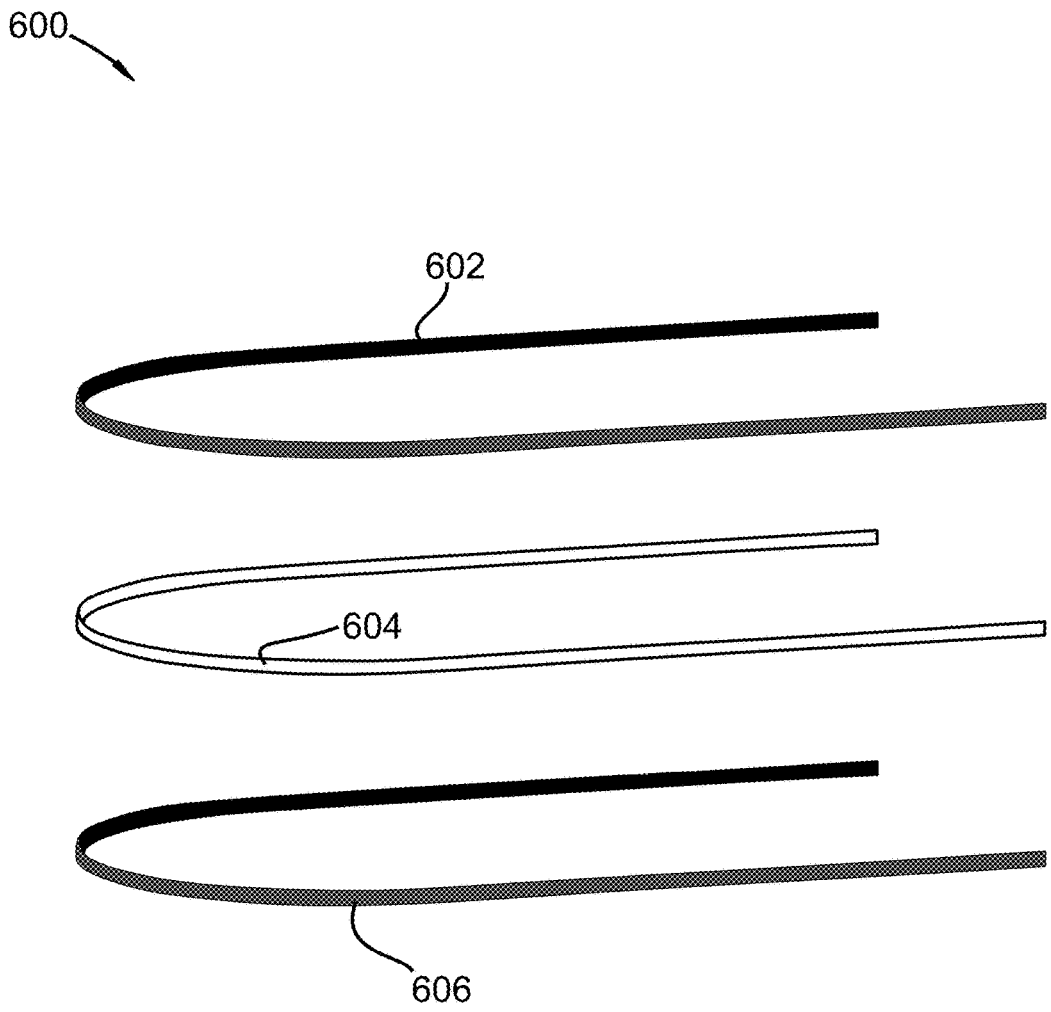
FIG. 6 is a detailed view of two diffuser strips surrounding an LED strip in accordance with an embodiment of the invention.
Figure 7:
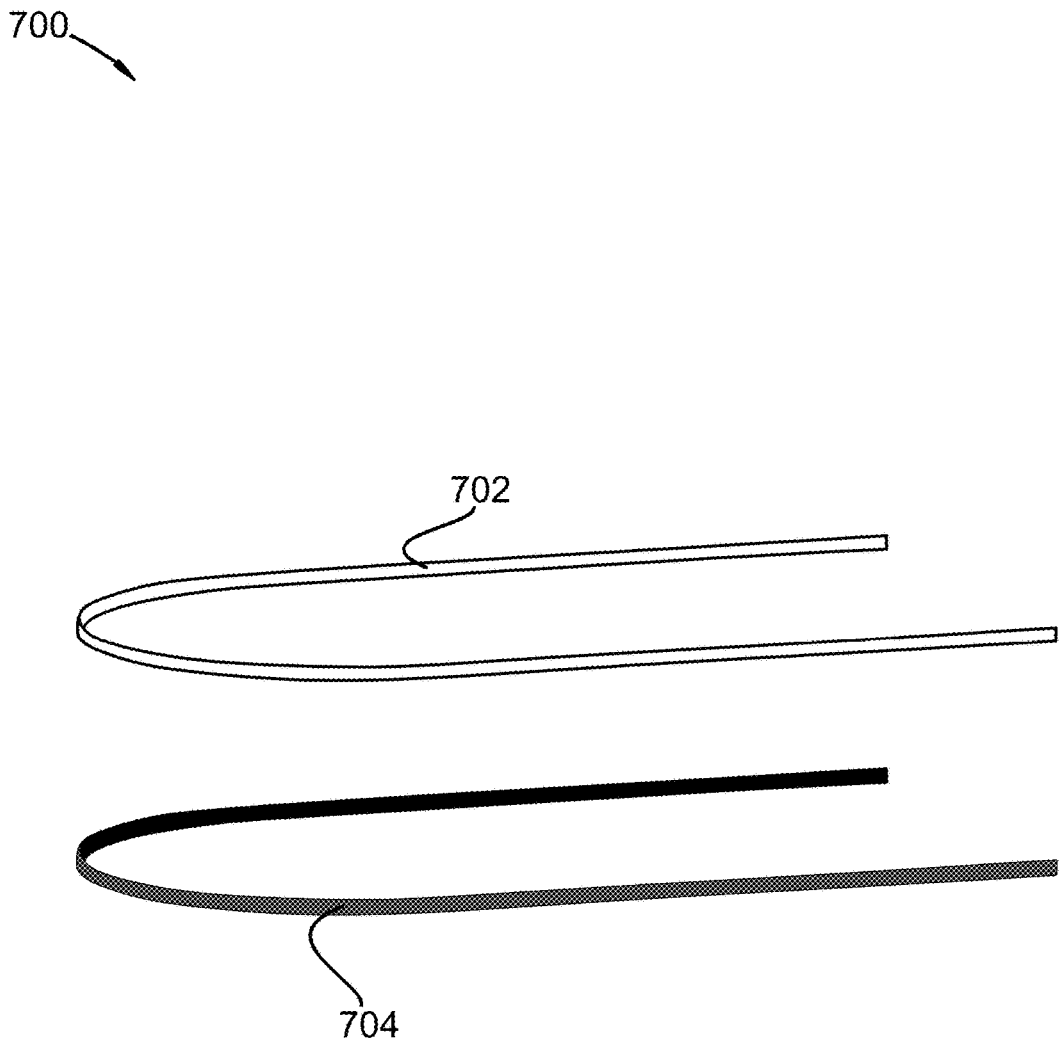
FIG. 7 is a detailed view of a single LED strip and diffuser strip in accordance with an embodiment of the invention.
Figure 8:
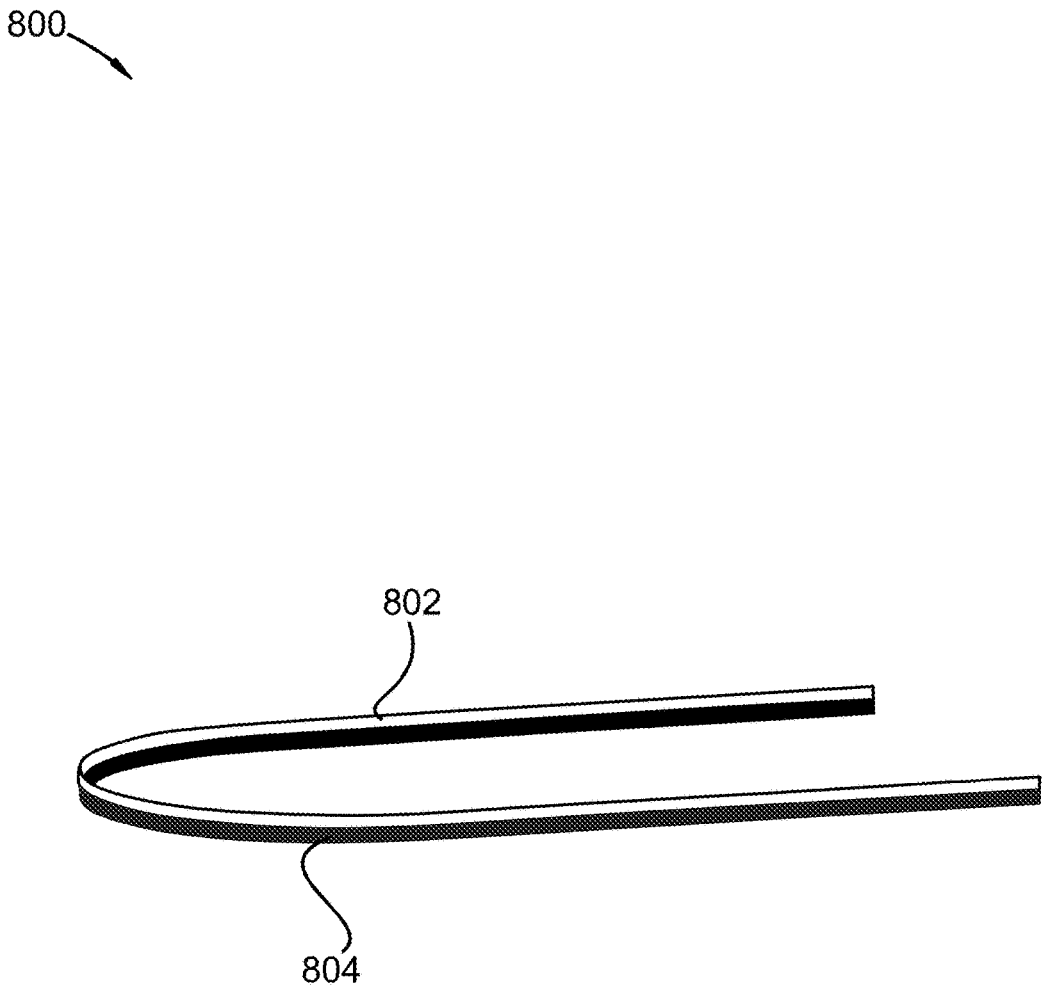
FIG. 8 is a detailed view of a joined LED strip and diffuser strip in accordance with an embodiment of the invention.

FIGS. 6-8 show several possible combinations of the LED strip and diffuser strip. In FIG. 6, a detailed look 600 at the LED strip and diffuser strip LED substrates of the toilet apparatus in accordance with an embodiment of the invention. Two diffuser strips 602 and 606 surround an LED strip 604. In FIG. 7, a detailed look 700 at the LED strip and diffuser strip LED substrates of the toilet apparatus in accordance with an embodiment of the invention. A single LED strip 704 is placed below a diffuser strip 702. In FIG. 8, a detailed look 800 at the LED strip and diffuser strip LED substrates of the toilet apparatus in accordance with an embodiment of the invention. The LED strip 804 and diffuser strip 802 are joined together. One or more of these configurations may be used in the toilet apparatus.

Figure 9:
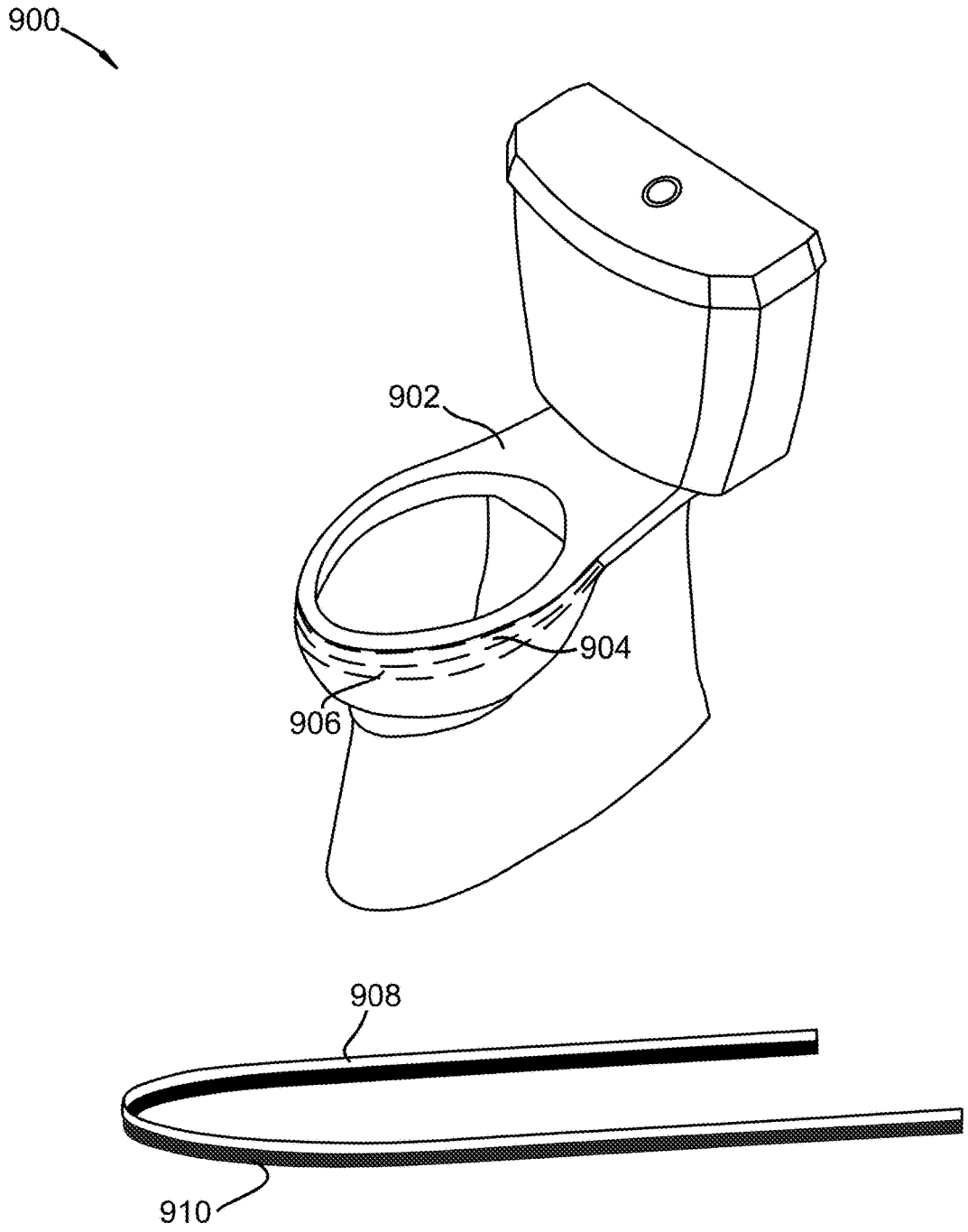
FIG. 9 is an isometric view showing the general location of a joined LED strip and diffuser strip on an embodiment of a two-piece toilet apparatus in accordance with an embodiment of the invention.

Referring to FIG. 9, a toilet apparatus 900 in accordance with an embodiment of the invention. The location of the joined LED strip 910 and diffuser strip 908 on the interior of the toilet bowl is shown using dashed lines 906 and 904, where 906 corresponds with the LED strip 910 and 904 corresponds with the diffuser strip 908. The actual toilet 902 may be designed in a fashion whereby it may accommodate other configurations of the LED strip and diffuser strip.

Figure 10A:
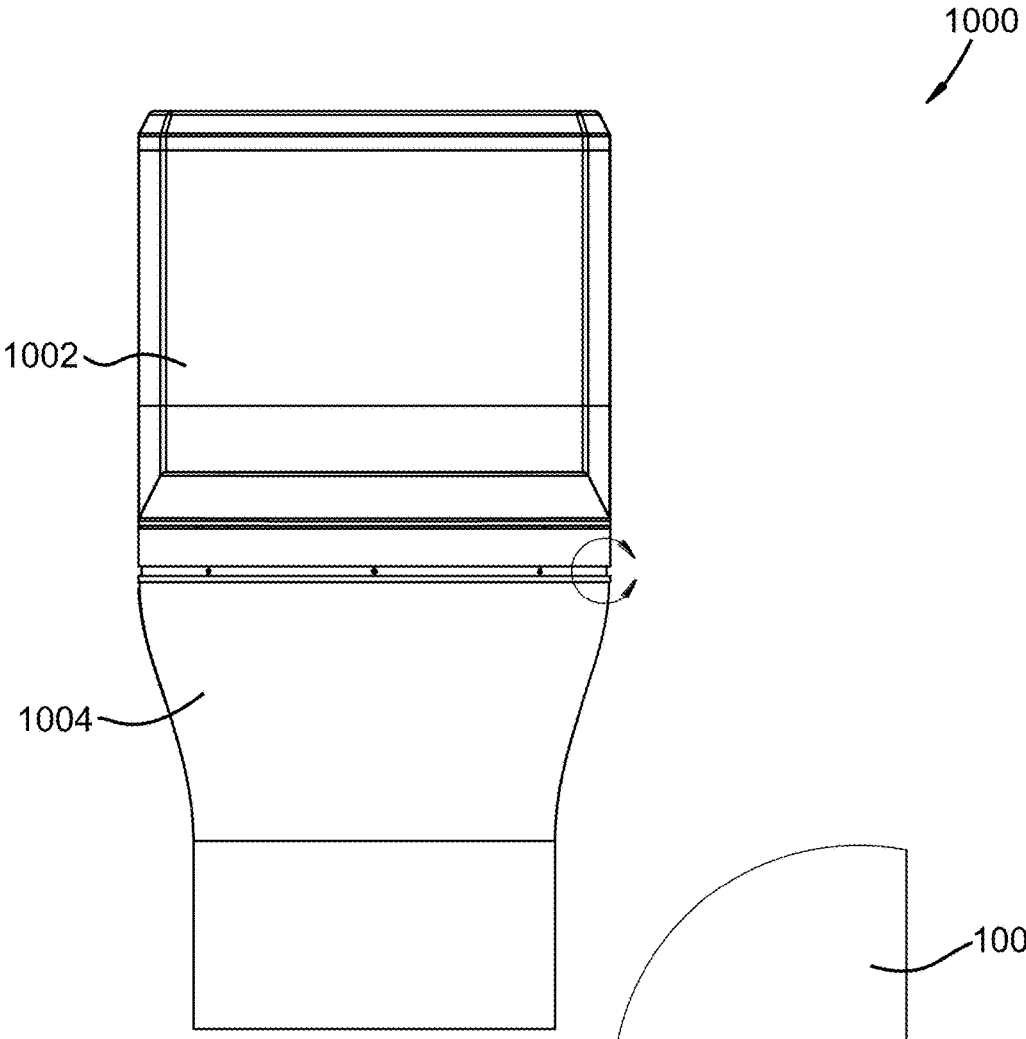
FIG. 10A is a front view of the seam section of an embodiment of the two-piece toilet apparatus in accordance with an embodiment of the invention.
Figure 10B:
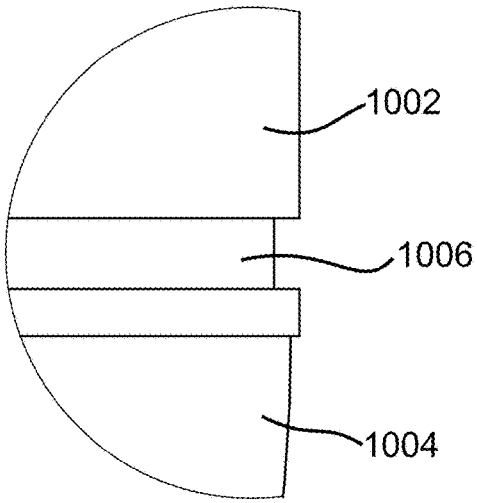
FIG. 10B is a zoomed in view of a seam section of FIG. 10A in accordance with an embodiment of the invention.

Referring to FIG. 10*a*, an embodiment of the toilet apparatus 1000 with a top section 1002 and bottom section 1004. A detailed view of the seam of the toilet apparatus delineated by an arrow on FIG. 10*a* is shown in FIG. 10*b*. The top section of the toilet 1002 is joined with the bottom section of the toilet 1004 to form a seam and channel 1006 for accommodating an LED strip and diffuser strip.

The toilet and methods disclosed herein may be embodied in other specific forms without departing from their spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A toilet apparatus comprising:

a strip of LEDs (light emitting diodes), the strip of LEDs being adjacent to a first diffuser strip;

a top section of the toilet apparatus attached to a bottom section of the toilet apparatus; and a seam forming a channel at an intersection of the top section and the bottom section, wherein the strip of LEDs and the diffuser strip are located within the channel and are used to hide the seam, and wherein the strip of LEDs emits a pattern of light intensity and color which indicates a length of time a user has used the toilet.

2. The toilet apparatus of claim 1, wherein the LEDs transmit light into the toilet apparatus through a partially transparent material.

3. The toilet apparatus of claim 1, wherein the LEDs transmit light around an external perimeter of the toilet apparatus.

4. The toilet apparatus of claim 1, wherein the LEDs transmit light into the toilet apparatus and around an external perimeter of the toilet apparatus.

5. The toilet apparatus of claim 1, wherein the toilet apparatus is made of at least one or more transparent or semi-transparent materials.

6. The toilet apparatus of claim 5, wherein the LEDs transmits light through the one or more transparent or semi-transparent materials.

7. The toilet apparatus of claim 1, wherein each LED in the strip of LEDs are individually addressable.

8. The toilet apparatus of claim 1, further comprising a second diffuser strip.

9. The toilet apparatus of claim 8, wherein the first diffuser strip and the second diffuser strip are located on opposite sides of the strip of LEDs.

10. A method of lighting a toilet comprising:

providing a strip of LEDs (light emitting diodes), within a seam forming a channel at an intersection of a top toilet section and a bottom toilet section, the strip of LEDs being adjacent to a first diffuser strip and filling in the channel and hiding the seam, wherein the strip of LEDs emits a pattern of light intensity and color which indicates a length of time a user has used the toilet; and using the toilet.

11. The method of claim 10, wherein the LEDs transmit light into the toilet through a partially transparent material.

12. The method of claim 10, wherein the LEDs transmit light around an external perimeter of the toilet.

13. The method of claim 10, wherein the LEDs transmit light into the toilet and around an external perimeter of the toilet.

14. The method of claim 10, wherein the toilet is made of at least one or more semi-transparent materials.

15. The method of claim 14, wherein the LEDs transmits light through the one or more transparent or semi-transparent materials.

16. The method of claim 10, wherein each LED in the strip of LEDs are individually addressable.

17. The method of claim 10, further comprising a second diffuser strip.

18. The method of claim 17, wherein the first diffuser strip and the second diffuser strip are located on opposite sides of the strip of LEDs.

* * * * *